United States Patent [19]

McMillan et al.

[11] Patent Number: 4,766,791

[45] Date of Patent: Aug. 30, 1988

[54] SLICING APPARATUS

[75] Inventors: Richard A. McMillan; Bruce M. Gavin; Edward A. Senner, all of Invercargill, New Zealand

[73] Assignee: Southland Frozen Meat Limited, New Zealand

[21] Appl. No.: 74,696

[22] Filed: Jul. 17, 1987

[51] Int. Cl.[4] ..... B26D 7/06

[52] U.S. Cl. ..... 83/155; 83/167; 83/409; 83/411 R; 83/422; 83/425.3; 83/439

[58] Field of Search ..... 83/155, 167, 169, 409, 83/409.1, 410, 411 R, 422, 425.2, 425.3, 439; 99/635, 642

[56] References Cited

U.S. PATENT DOCUMENTS

| | | | |
|---|---|---|---|
| 237,161 | 2/1881 | Brown | 83/411 R |
| 561,278 | 6/1896 | Perkins | 83/411 R |
| 978,408 | 12/1910 | Spill | 83/409.1 |
| 1,200,136 | 10/1916 | Richardson | 83/422 |
| 1,925,143 | 9/1933 | Hartman | 83/409.1 |
| 2,078,177 | 4/1937 | Hickman | 83/409.1 |
| 2,197,978 | 4/1940 | Hoon | 83/422 |
| 3,788,176 | 1/1974 | Glass | 83/409.1 |
| 4,391,172 | 7/1983 | Galland et al. | 83/411 R |

*Primary Examiner*—E. R. Kazenske
*Assistant Examiner*—Scott A. Smith
*Attorney, Agent, or Firm*—Steele, Gould & Fried

[57] ABSTRACT

A slicing apparatus particularly suitable for slicing livers. A plurality of adjacently spaced apart blades are mounted within a drum rotatable about the blades. The blades are disposed toward one side of the drum in close proximity to the peripheral wall thereof to form a cutting zone. Pockets are provided in the peripheral wall of the drum, the pockets being formed with gaps which align with the blades. As the drum and the pockets rotate through the cutting zone, the blades pass through the pockets and slice livers therein. The cutting zone is positioned in a lower quadrant of the drum and, with respect to the drum's rotational direction, immediately before lower dead-center thereof. Thus as a pocket enters the cutting zone it is being inverted and on exiting the cutting zone a pocket has been completely inverted. On exiting the cutting zone the sliced contents are deposited into a tray provided on a packaging tray conveyor positioned adjacently beneath the drum. The action of the drum and the conveyor are co-ordinated to register the positioning of a tray with the arrival of the pockets at the lower dead-center position. A retaining block mounted on pneumatic rams is provided to impinge on to a liver as the supporting pocket therefor becomes inverted and passes through the cutting zone. The retaining block retracts as a pocket leaves the cutting zone to register with the next set of pockets as they enter the cutting zone.

6 Claims, 3 Drawing Sheets

SLICING APPARATUS

BRIEF SUMMARY OF THE INVENTION

This invention relates to slicing apparatus and, in particular, relates to an apparatus for both the industrial slicing of foodstuffs, for example, livers, into a plurality of individual slices and also the subsequent packaging of the slices.

An intention of this invention is to provide an apparatus in which a workpiece, in particular a foodstuff item such as a liver, can be placed and subsequently sliced and packaged. A further intention is to provide such a slicing apparatus which can include a plurality of workpiece stations and which can be operated in a continuous manner to achieve a substantial through put and thus render the device suitable for industrial utilisation. Yet a further object is to provide that the slices from a particular liver are not mixed with slices from another liver during a slicing operation and the subsequent packaging of those sliced livers.

According to a first aspect of this invention there is provided a slicing apparatus comprising a plurality of cutting elements disposed in adjacent spaced apart parallel relationship within a interior of a drum, the drum being rotatably supported about a horizontally disposed axis of rotation and the parallel disposition of the cutting elements extending longitudinally of the drum with cutting edges of the cutting elements being operative in a cutting zone disposed in juxtaposition to an inner side of a peripheral wall of the drum, at least one outwardly opening pocket set into the peripheral wall of the drum, a pocket being formed by a plurality of adjacently spaced apart elements forming open slots therebetween, the slots being aligned with the cutting elements which can thus pass through the pocket with rotation of the drum, a workpiece retaining element mounted externally of the drum in conjunction with actuation means operable to impinge the workpiece retaining element onto a workpiece in a pocket as the pocket, with rotation of the drum approaches the cutting zone, to be rotated about with the pocket, the workpiece retaining element being mountable on a guide extending adjacently about the cutting zone and the actuating means retracting and resetting the workpiece retaining element upon exiting the cutting zone, and means to support a packaging element as to collect a sliced workpiece deposited from a supporting pocket after the pocket exits the cutting zone and is inverted with rotation of the drum.

BRIEF DESCRIPTION OF THE DRAWINGS

FIG. 5 is an enlarged plan view of a drum mounting region, indicated by arrow A on

FIG. 2.

DETAILED DESCRIPTION OF THE INVENTION

Figure 1:
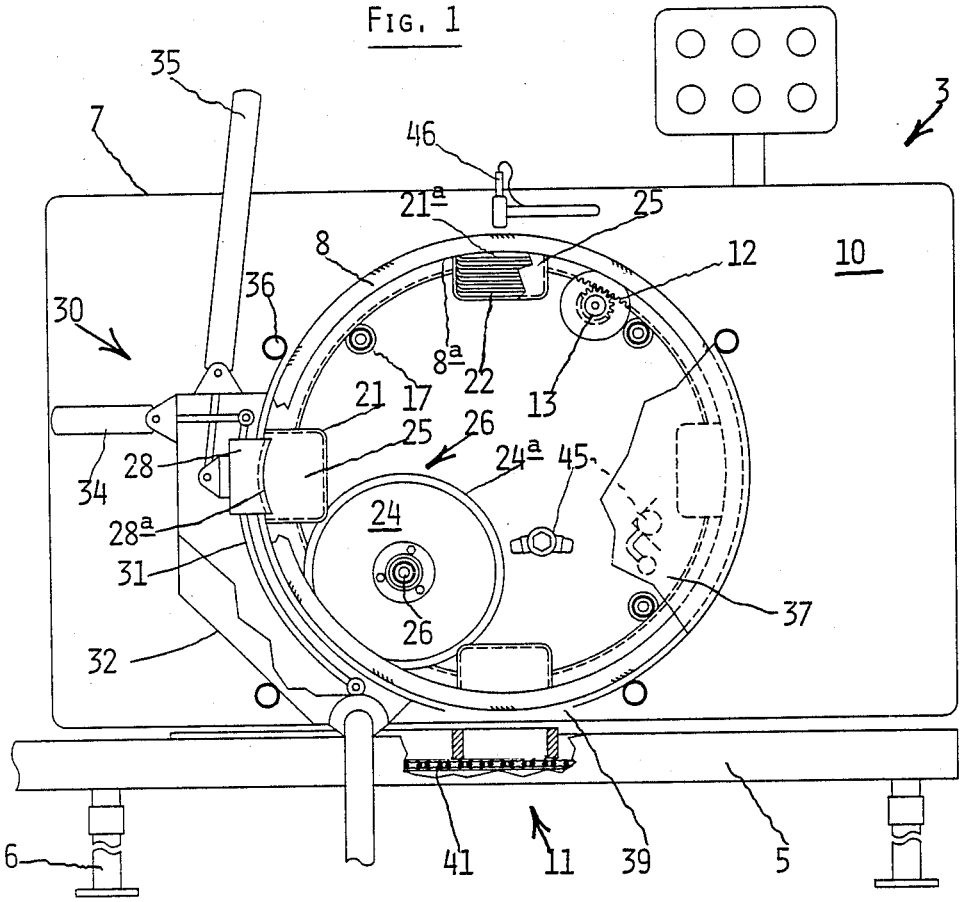
FIG. 1 is a front elevation with, for the sake of clarity, various foreground elements depicted truncated.
Figure 5:
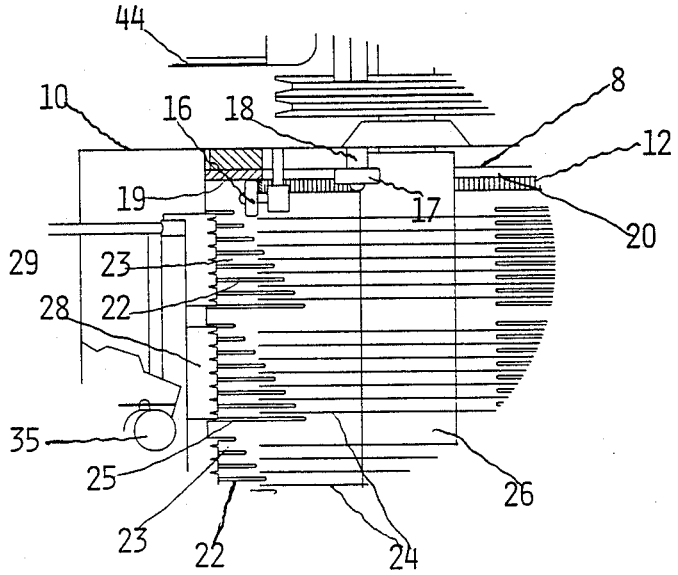

A slicing apparatus 3, particularly suitable for the industrial slicing and packaging of animal livers, is fabricated predominantly from stainless steel. A base 5, preferably with adjustable height legs 6, supports, preferably at table height, a cabinet 7 housing various prime movers, transmission units and adjunct controls required for operating the apparatus 3 as more particularly described hereinafter. A drum 8 is fabricated from sheet stainless steel to be about 1 meter in diameter and 700 mm in length, the drum 8 being open at both ends. Drum 8 is mounted in cantilevered manner with its longitudinal axis and axis of rotation disposed horizontally of a front wall 10 of cabinet 7. The base 5 is disposed beneath both the cabinet 7 and the drum 8 with tray packaging means 11, described in more detail hereinafter, being supported by the base 5 adjacently beneath the drum 8. At an inner and mounting end of drum 8 a ring gear 12, preferably internally mounted, is provided to mesh with a drive gear 13 mounted to a drive shaft 14 extending through wall 10 and forming an output shaft from a drive transmission gearbox 15 suitably mounted within cabinet 7.

Roller bearings 17, or similar elements, are mounted such as by stub axles 18 to the wall 10 of cabinet 7 to impinge onto an outer lateral face 19 of ring gear 13. Roller bearings 16, together with similar roller bearings 17, mounted radially inward of an annular track 20 formed on ring gear 12, support the drum 8 in its cantilevered disposition, the roller bearings 16 and 17 being disposed at suitably spaced apart intervals about ring gear 12, the drum 8 thus rotating about roller bearings 17.

Figure 2:
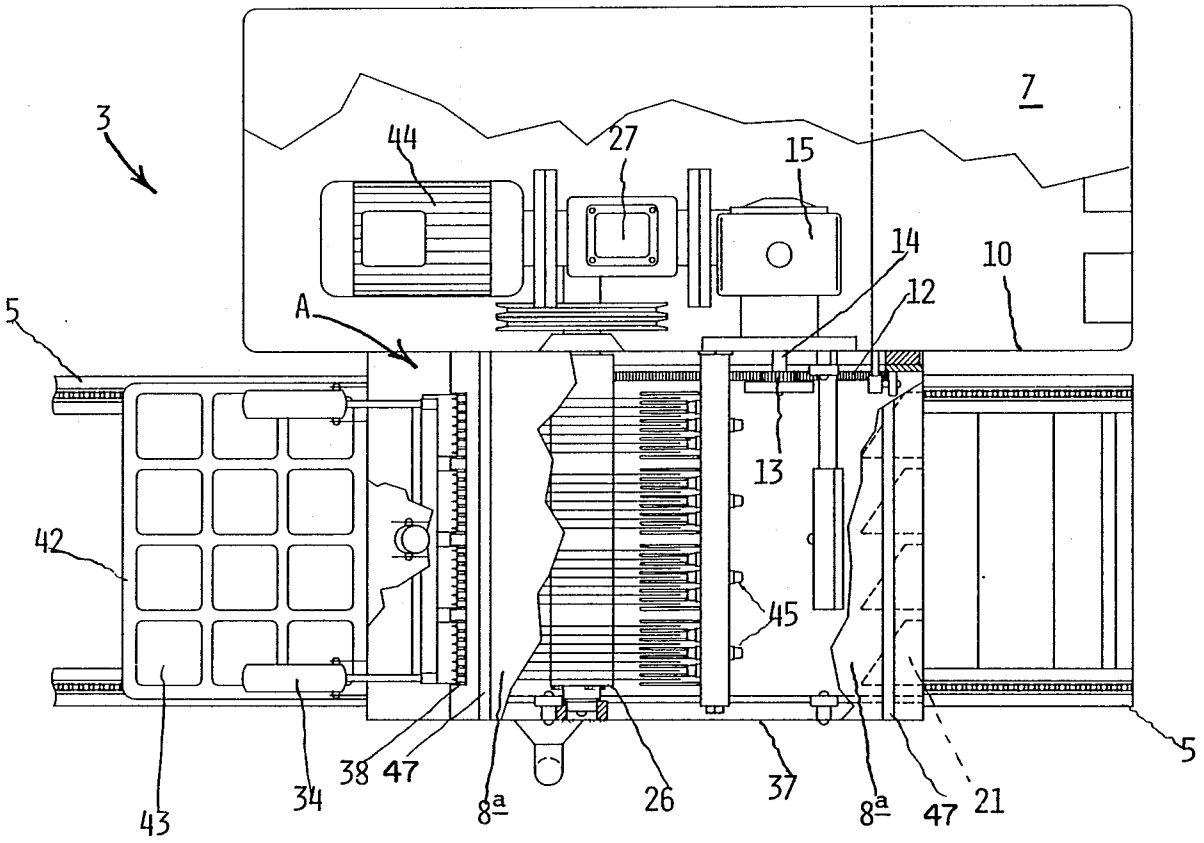
FIG. 2 is a plan view, again, for the sake of clarity, with various foreground elements depicted truncated.

At least one workpiece (not depicted) supporting pocket 21 is formed in a peripheral wall $8^a$ of the drum 8. Preferably four sets of pockets 21 are provided at equal spaced apart intervals about the drum 8 with preferably four pockets 21 being provided to each set of pockets 21. The pockets 21 of a set are spaced in alignment with one another longitudinally of the drum 8. Each pocket 21 is formed by a cut-out from the peripheral wall $8^a$ forming an opening $21^a$ thereto with a pocket being supported on the inner face of the peripheral wall $8^a$ about and defining an associated opening $21^a$ to extend inwardly of the drum 8. A pocket 21 is preferably formed by a plurality of essentially U-shaped elements 22, for example, lengths of stainless steel rod so shaped, having their ends attached, such as by welding, to the inner face of the drum wall $8^a$. The ends of a pocket 21 are formed and closed by a plate 25 similarly mounted to the wall $8^a$. The U-shaped elements 22 are adjacently spaced apart in parallel relationship to form slots 23 therebetween, the slots 23 enabling entry of cutting devices 24 into a pocket 21 as hereinafter described. Referring in particular to FIG. 2, in a preferred embodiment the depth of a pocket 21 increases from one end to the other, to that end the elements 22 varying in the depth of their extension into drum 8. An angled slicing through of a workpiece in such a pocket 21 can thus result thereby achieving, as can be considered desirable, more elongated slices of the workpiece than if a pocket 21 of uniform depth was provided.

A plurality of cutting elements 24 are operably mounted within the drum 8 to achieve slicing of a workpiece, for example, a liver, located in a pocket 21. Preferably the cutting elements 24 comprise a plurality of rotatable circular blades 24 mounted in adjacent spaced apart parallel intervals on a common drive shaft 26. Preferably the drive shaft 26 extends from a drive transmission unit 27 mounted in the cabinet 7, shaft 26 extending through the dividing wall 10 and into the interior of the drum 8. Shaft 26 extends for essentially the full length of the drum 8 and the blades 24 are mounted thereon in spaced apart intervals corresponding to and in arcuate alignment to the slots 23 provided in the pockets 21. In the preferred embodiment the blades 24 have a continuous cutting edge 24$^a$ rather than a saw-tooth configuration. The assembly of the apparatus provides that a small working tolerance, of about 1 mm, is provided between the peripheral cutting edge 24$^a$ of a blade 24 and the inner face of the drum wall 8$^a$.

Figure 4:
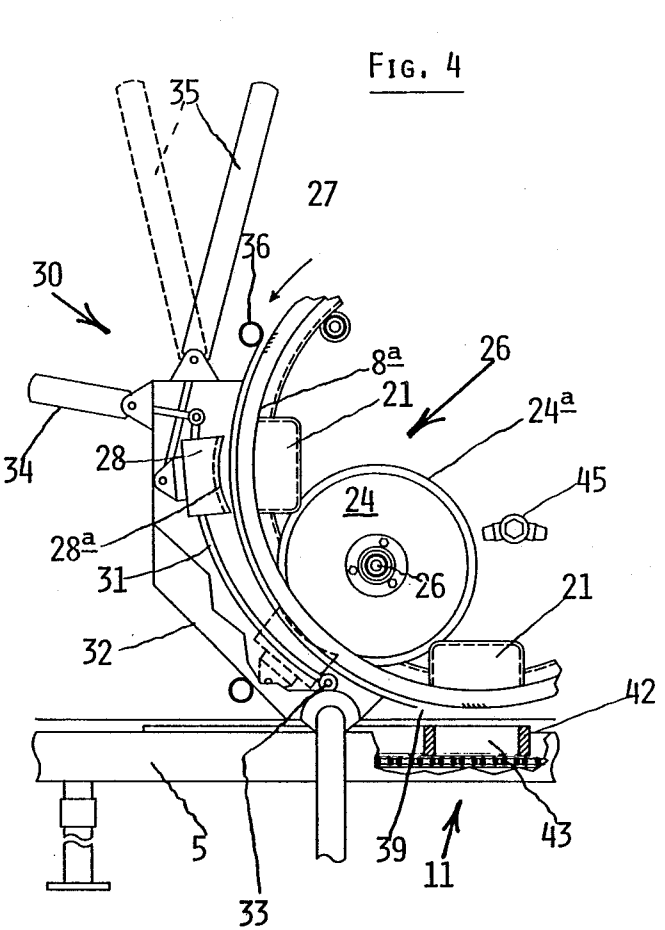
FIGS. 3 and 4 are enlarged front elevational views of a cutting zone of the apparatus and depicting different stages of the operation thereof.
Figure 3:
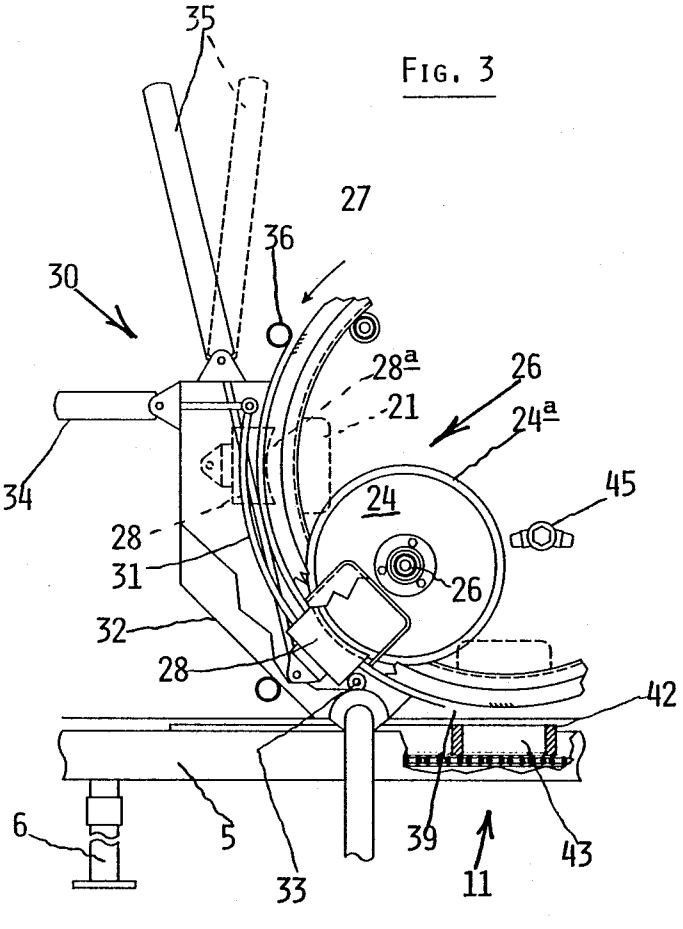

Referring in particular to FIGS. 3 and 4, the blades 24, their mounting shaft 26 and the adjacent section of the drum's path, form a cutting zone 26 within which, as the pockets 21 pass with rotation of the drum 8, the blades 24 pass through the pockets 21 via the slots 23 and slice the contents within a pocket 21. Preferably the cutting zone 26 is disposed adjacently before (with respect to the direction of rotation, indicated by arrow 27, of the drum 8) a lower dead-centre position of the drum's rotational path. In the drawings the cutting zone 26 extends from substantially a 9 o'clock position to a 6 o'clock position.

A retaining element 28 is provided to retain a workpiece in a pocket 21 as a pocket 21 approaches the cutting zone 26 and tends to become inverted with rotation of the drum 8. A retaining element 28 is preferably in the form of a block of suitable plastics material mounted to be impinged on to a workpiece in a pocket 21. Separate blocks 28 can be provided for each pocket 21 of a set of pockets or a single retaining block 28 can be provided to span and enter all the pockets 21 of a set of pockets. A retaining element 28 preferably has a concave inner face 28$^a$ formed with grooves 29 therein disposed to align with and provide a clearance for the blades 24 to thus ensure a complete slicing through of a workpiece impinged into a pocket 21 and thus on to the blades 24 by the retaining block 28.

Actuation means 30 are provided to operate in conjunction with retaining elements 28 to impinge them into a pocket 21 as aforesaid and allow travel of a retaining element 28, with a pocket 21, through the cutting zone 26 and subsequent retraction and resetting in readiness for a next set of pockets 21. To that end, retaining block 28 is mounted on a track, for example, an arcuately shaped rod 31, mounted on a cowling 32, described in more detail hereinafter, to extend about the drum adjacently outward of the cutting zone 26. A block 28 incorporates an aperture therethrough with a rod 31 passing therethrough enabling a retaining block 28 to traverse up and down the length of the rod 31. Preferably the aperture in the retaining element is oversized to provide a floating or lost-motion mounting between a retaining element 28 and rod 31 and in particular enable a retaining element 28 to be rocked on rod 31, as more particularly described hereinafter. Rod 31 is articulately mounted at its upper and lower ends, in the latter case to cowling 32, as described in more detail hereinafter. The upper end of rod 31 is connected to a pneumatic ram 34, or similar unit, in turn pivotally mounted to cowling 32 as depicted. Extension and retraction of ram 34 rocks rod 31 about its lower pivotal mounting 33 to thus radially impinge retaining element 28 into a pocket 21 (as depicted in phantom on FIG. 3) at the start of that pocket 21 entering the cutting zone and retracts it therefrom following traversing of the retaining element 28 with the pocket 21, that is, from a lower position as depicted in phantom on FIG. 4. In addition, a further essentially vertically mounted and operable pneumatic ram 35 is articulately coupled to retaining element 28 to provide for its return up rod 31.

In a preferred embodiment a cowling 32 is provided to extend about essentially the lower half of the drum 8. Preferably cowling 32 is fabricated from sheet stainless steel and is supported on support rods 47 extending from wall 10 of cabinet 7, bushes 36 being formed on the upper edges of the cowling 32 to thus enable the cowling 32 to be slid on to the rods 47 and be supported thereby. A small working tolerance is provided between the outer face of wall 8$^a$ and the cowling 32. Preferably cowling 32 includes a disc-shaped end plate 37 such that with assembly of aforesaid end plate 37 closes off the otherwise open projecting end of drum 8.

Cowling 32 incorporates a cut-out 38 at the region of the cutting zone 26 enabling access of the retaining element 22 to the pockets 21 as aforesaid. At a lower end cut-out 38 terminates immediately after the blades 24 begin to move back from the drum wall 8$^a$. It is at this stage that retaining element 28 is also displaced and raised once again as aforesaid to repeat the cycle, the lower articulate mounting 32 of rod 31 being mounted to cowling 32 in this region. The immediately lower section of cowling 32 acts as an undercover for the pockets 21, closing the openings 21$^a$ thereof, and retains the sliced pieces of a workpiece in their respective pockets 21. It is to facilitate this transfer of a workpiece being retained first by retaining element 28 and then cowling 32 that the mounting of retaining element 28 provides for a rocking action, the operation of the rams 34 and 35 being co-ordinated to provide that the trailing edge section of retaining element 28 remains in contact with a workpiece as the associated pocket 21 exits from the cut-out 38.

Cowling 32 includes a further cut-out 39 at its lowermost extremity, thus as pockets 21 rotate past the cut-out 39, the contents of a pocket 21 will be deposited therefrom.

Preferably packaging means 11 are provided to receive the sliced workpieces as they are deposited as aforesaid. In a preferred embodiment a conveyor 41 of suitable known form is provided to pass adjacently beneath the drum 8. Suitable packaging trays 42 having, for example, a cavity 43 layout conforming with the layout of the pockets 21 of the drum 8, are placed on the conveyor 41. The operation of the conveyor 41 is co-ordinated with the remainder of the apparatus to provide that a row of cavities 43 of the packaging tray 42 are positioned adjacently beneath the lower dead-centre position, that is, beneath cut-out 39, of the drum 8 as to register with a set of pockets 21 arriving at that point.

Preferably the apparatus is driven from a parent electric motor 44 mounted in cabinet 7 and operating through transmission units 27 and 15. Control circuitry, both electric and pneumatic, is provided for cycling of the apparatus. Such controls preferably also include a washing sequence via nozzles 45 and associated conduits appropriately positioned within drum 8 to provide for the cleaning thereof. To that end cowling 32 is disposed to extend in the manner described and prevent, or at least limit, splashing.

A preferred operation of the apparatus is as follows. A sensor 46 provides that rotation of drum 8 is temporarily stopped when a set of pockets 21 is positioned at top dead-centre. Workpieces, for example livers, are placed in a set of pockets 21. As the drum rotates, in the direction of arrow 27, the so-charged pockets 21 pass inside the upper extremity of cowling 32 and begin to enter the cutting zone 26. At this stage retaining element 28 is at the upper end of rod 31 and with operation of ram 34 retaining element 28 is impinged on to the workpieces in the pockets 21. With further rotation of drum 8 retaining element 28 rotates therewith, the actuating rams 34 and 35 also being operated to maintain the register of retaining element 28 within a pocket 21. As the drum rotates blades 24 pass through the pockets 21 and slice the workpiece. Following slicing, retaining element 28 is withdrawn and repositioned by operation of the rams 34 and 35 in readiness for the further set of pockets and the sliced workpieces are rotated with their supporting pocket 21 until reaching cut-out 39 where they discharge into cavities 43 of trays 42. The rotary cycle is repeated with, as appropriate, washing of the apparatus taking place to maintain hygiene requirements.

We claim:

1. A slicing apparatus comprising a plurality of cutting elements disposed in adjacent spaced apart parallel relationship within an interior of a drum, the drum being rotatably supported about a horizontally disposed axis of rotation and the parallel disposition of the cutting elements extending longitudinally of the drum with cutting edges of the cutting elements being operative in a cutting zone disposed in juxtaposition to an inner side of a peripheral wall of the drum, at least one outwardly opening pocket set into the peripheral wall of the drum, said at least one pocket being formed by a plurality of adjacently spaced apart elements forming open slots therebetween, the slots being aligned with the cutting elements which can thus pass through said at least one pocket with rotation of the drum, a workpiece retaining element mounted externally of the drum in conjunction with actuation means operable to impinge the workpiece retaining element onto a workpiece in said at least one pocket as said at least one pocket, with rotation of the drum approaches the cutting zone, to be rotated about with said at least one pocket, the workpiece retaining element being mounted externally of the drum on a guide extending adjacently about the cutting zone and the actuating means retracting and resetting the workpiece retaining element upon exiting the cutting zone, and means to support a packaging element as to collect a sliced workpiece deposited from said at least one pocket after said at least one pocket exits the cutting zone and is inverted with rotation of the drum.

2. A slicing apparatus as claimed in claim 1 wherein said at least one pocket comprises a plurality of pockets being disposed in sets at equally spaced apart intervals about the peripheral wall of the drum, the pockets of a set extending, in alignment with one another, longitudinally of a drum and wherein the cutting zone is disposed adjacently before, with respect to the direction of rotation of the drum, a lower dead-centre position and wherein the packaging element support means includes a conveyor mounted to extend adjacently beneath the drum.

3. A slicing apparatus as claimed in claim 2 wherein the cutting elements comprise rotatable circular blades mounted on a common drive shaft and wherein the workpiece retaining element comprises a block incorporating a concave inner and workpiece contacting face formed with grooves aligned with the blades.

4. A slicing apparatus as claimed in claim 3 wherein the depth of the pockets increases from one end to the other.

5. A slicing apparatus as claimed in claim 1 wherein said at least one pocket is formed by lengths of rod bent into a "U" shape and fastened at their ends to a section of the inner face of the drum wall adjacently about a cut-out formed therein, the lengths of rod being adjacently spaced apart to form cutting device accommodating open gaps therebetween.

6. A slicing apparatus as claimed in claim 4 wherein the actuation means comprises an arcuately shaped rod disposed adjacently outward of the cutting zone, the rod being articulately mounted at its upper and lower ends with the upper end being connected to a radially operable ram, the retaining element being slidingly mounted on the rod and a further and vertically operable ram being connected to the block to traverse the block up and down the rod and wherein a cowling is mounted about substantially a lower half of and also the otherwise open end of the drum and wherein washing devices, control circuits and controls are provided to cyclically operate the apparatus including providing wash stages.

* * * * *